US005426819A

United States Patent [19]

Rohn

[11] Patent Number: 5,426,819

[45] Date of Patent: Jun. 27, 1995

[54] DOOR HOLDING METHOD AND APPARATUS

[76] Inventor: William B. Rohn, 519B Heritage Village, Southbury, Conn. 06488

[21] Appl. No.: 245,525

[22] Filed: May 18, 1994

Related U.S. Application Data

[63] Continuation of Ser. No. 796,835, Nov. 25, 1991, abandoned.

[51] Int. Cl.[6] ..... E05F 5/02

[52] U.S. Cl. ..... 16/82; 16/353

[58] Field of Search ..... 16/82, 223, 353, 329, 16/338, 320

[56] References Cited

U.S. PATENT DOCUMENTS

| | | | |
|---|---|---|---|
| 1,493,690 | 5/1924 | Martin | 16/223 |
| 2,723,419 | 11/1955 | Christopher | 16/353 |
| 2,917,770 | 12/1959 | Etnyre | 16/82 |
| 3,650,557 | 3/1972 | Dudley | 16/329 |
| 3,796,451 | 3/1974 | Schultz | 16/82 |
| 3,965,531 | 6/1976 | Fox et al. | 16/338 |
| 4,506,407 | 3/1985 | Downey | 16/320 |

*Primary Examiner*—P. Austin Bradley
*Assistant Examiner*—Chuck Y. Mah
*Attorney, Agent, or Firm*—George E. Kersey

[57] ABSTRACT

Holding of a vehicular door by controllably and securely engaging the door in any of a large number of prescribed positions, particularly while leaving or entering the vehicle. The selected positions can be held securely by a ratchet and pawl, a friction brake or electromagnetic engagement. The door holding mechanisms can be mounted on the vehicular door and frame, and be activated and released by essentially the same actuator, which illustratively is electromechanical.

16 Claims, 5 Drawing Sheets

DOOR HOLDING METHOD AND APPARATUS

This is a file wrapper continuation of Serial No. 07/796,835 filed Nov. 25, 1991, now abandoned.

BACKGROUND OF THE INVENTION

This invention relates to the holding of doors in prescribed, fixed positions, and more particularly, to the holding of vehicular doors in such positions.

In current practice, the doors of vehicles are provided with mechanical detents to hold doors open at one or two positions, as there is entry or departure from the vehicle. This arrangement can be unsatisfactory, and often hazardous. The spring force of the mechanical detents intentionally has a low enough magnitude to be easily overcome in closing the door. Consequently, the spring force is frequently overcome by wind or gravity. This is particularly a problem if the vehicle is parked on a transverse incline with one side slightly elevated.

Inadvertent closure of a door can take place with such force that injury can result. This is particularly true when there is an attempt to leave the vehicle.

In addition, the provision of one or two detents often fails to meet specific needs. For example, the detents can hold a door either too near or too far to accommodate the physical sizes of vehicular occupants, or may be unsuitable if there are obstructions on the side of a parked vehicle.

Accordingly it is an object of the invention to provide the occupant of a vehicle with greater flexibility in door positioning. A related object is to hold a car door securely in a selectable and prescribed position.

A further object of the invention is to provide secure positioning which will provide other advantages not presently available. A related object is to provide for secure auxiliary ventilation in cars with electric windows that cannot be operated with the ignition key removed. Another related object is to provide increased facility for getting packages out of and into a car. Still another related object is to permit the eating of snacks at rest stops while sitting on the sides of the car seats knowing that open doors will be held securely in position.

SUMMARY OF THE INVENTION

In accomplishing the foregoing and related objects, the invention provides for controlling the positions at which a door can be held securely by a mechanism mounted on the door, and selectively engaged after being activated.

In accordance with one aspect of the invention, the door is attached to the frame of a vehicle and is to be held securely in a prescribed position by making use of a ratchet wheel with teeth that are engaged by a pawl and solenoid assembly mounted on the the frame. The pawl is held disengaged from the teeth of the ratchet wheel by a restraining spring in the pawl assembly. A solenoid for the pawl is energized so that magnetic force generated by the solenoid acts on a member of the pawl assembly to overcome the force of the restraining spring and engage the ratchet teeth by the pawl.

In accordance with another aspect of the invention, the number of securely held positions for the door is provided by the number of teeth on the ratchet. The door swings from a closed to fully open position through an arc of about 70° and the ratchet wheel section is confined to one quadrant of a circle, with the ratchet teeth in about a 60° to 70° arc of the wheel section, and 3 to 4 teeth per inch along the circumference of a 3-inch radius wheel section.

In accordance with a further aspect of the invention, activation is by an energizing circuit, which can selectively activate a holding mechanism. The energizing circuit can activate the door holding mechanism regardless of the side from which the door is opened. Switches for releasing the door holding mechanism can be provided in user convenient positions to provide access on both sides of the door.

In accordance with yet another aspect of the invention, failure of the energizing circuit causes deactivation, establishing normal operation; whereby the mechanism is fail-safe and ensures that the door will not be locked in an outward position in the event of an electrical system failure. When the energizing circuit includes a solenoid, failure causes a pawl restraining spring to deactivate a ratchet mechanism.

A lockout switch can be associated with door so that the door-hold mechanism is not activated if a door is accidently opened. When the door is on a car, the lockout switch can be associated with the car ignition switch so that the door-hold mechanism is not activated if a door is accidently opened while the car is in motion.

When the ratchet wheel section is mounted on the car door, it is advantageous for the wheel center to be aligned with the axis of the door hinges. This ensures that the ratchet wheel has only rotational movement as the door is opened and no transverse component of motion so that the ratchet wheel will exert only a tangential force on the pawl, and there will be no radial component of force that would tend to push the pawl back against the action of the solenoid. When there is an incline of the door plane to the vertical, this achieves a slight inward component of gravitational force on the door and provides a tendency for the door to swing closed, even on a level surface. This keeps the ratchet and pawl securely engaged.

In accordance with still another aspect of the invention, the door can be attached to the frame of a vehicle and held securely in a prescribed position by a brake drum and a brake shoe mounted on said frame.

Alternatively, when the door is attached to the frame of a vehicle, and is to be held securely in a prescribed position, electro-mechanical receptor can be operated with respect to an electro-mechanical contactor mounted on the frame.

In a method of controlling the positions at which a door can be held securely, the steps include (a) engaging a receiving mechanism mounted on the door; and (b) disengaging the engagement. When the door is attached to the frame of a vehicle, and is to be held securely while the vehicle is parked, the engagement mechanism can be mounted on the frame. When a friction brake is used to hold the door, the door is opened with the braking deactivated until the desired position is reached, after which the braking mechanism is activated and subsequently deactivated. This provides a continuous choice of door positions.

In a method of providing for control over the positions at which a door can be held securely, the steps include (a) mounting a receiving mechanism on the door; (b) providing for engagement of the receiving mechanism; and (c) providing for activating the engaging means.

DESCRIPTION OF THE DRAWINGS

Further aspects of the invention will become apparent after considering several illustrative embodiments, taken in conjunction with the drawings in which.

DETAILED DESCRIPTION

With reference to the drawings, the mechanical features of the invention are illustrated for application to left-side car doors. It will be understood that the mirror-image of the depicted arrangements apply to right-side car doors.

Figure 1:
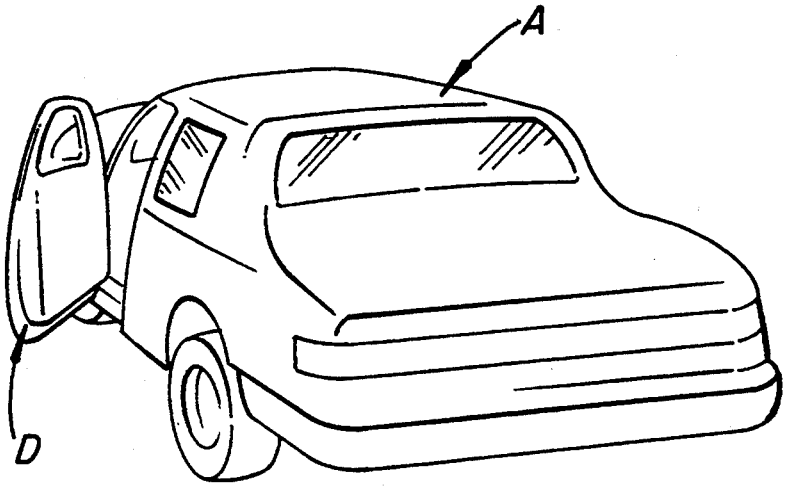
FIG. 1 is a perspective view showing an automobile parked on an incline with a left-side car door being held securely in a prescribed open position.

As illustrated in FIG. 1, an automobile A parked on an incline has its left-side driver's door partially opened. With conventional door holding mechanisms, it is unlikely that the door would remain in the open position as shown. In addition, any slight disturbance could cause the door to move from its partially opened position and close, possibly upon an occupant who is seeking to leave the vehicle. The invention overcomes the short comings and disadvantages of existing door holding arrangements by providing for the controlled and secure positioning of the door in a prescribed open position.

Figure 2A:
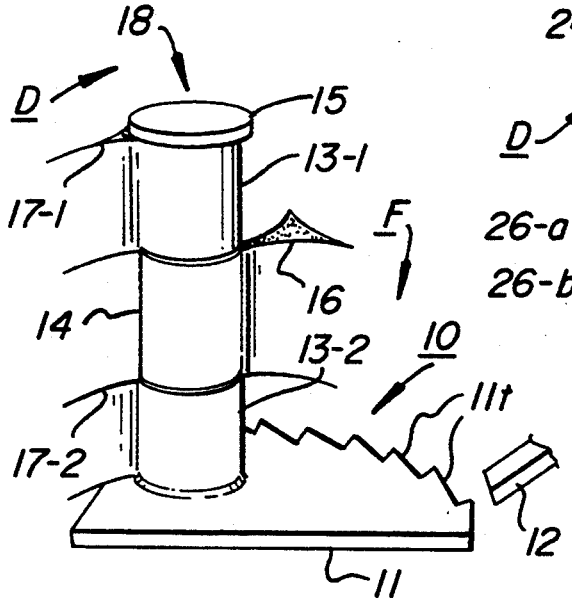
FIG. 2A is a perspective view of a ratchet wheel section affixed to the cylindrical hinge of a left-side car door for use in holding the door securely in the prescribed open position of FIG. 1.

In accordance with one embodiment of the invention, a ratchet and pawl mechanism 10 as shown in FIG. 2A is included with a cylindrical-type hinge 18 for a left-side car door. Upper and lower cylinders, 13-1 and 13-2 respectively of the hinge 18 are rigidly affixed to respective mounting flanges 17-1 and 17-2 and securely fastened to the car door D. A middle cylinder 14 is affixed to a flange 16 which is in turn secured to the car frame F.

The hinge cylinders 13-1 and 13-2 rotate around a hinge bolt 15. A section of a ratchet wheel 11 is shown rigidly attached to the bottom hinge cylinder 17-2. A pawl tip 12 which extends from an assembly (not shown in FIG. 1) mounted on the car frame F and described in detail below.

When looking down on the hinge structure 18 from the top, it will be seen that the ratchet 11 will rotate clockwise when the door D is opened, and counterclockwise when the door D is being closed. When the pawl 12 is engaged with the ratchet 11, and the door D is being opened, the pawl 12 will slide over the ratchet teeth 11*t* until the door ceases to be opened any further. At this point, the last tooth traversed will engage the pawl 12, preventing counterclockwise rotation of the ratchet 11 and thereby preventing the door D from closing. To close the door D, the pawl 12 must be disengaged from the ratchet 11. The ratchet and pawl assembly are made of sufficiently strong material to repeatedly withstand moderate forces against the door D without damage.

Figure 2B:
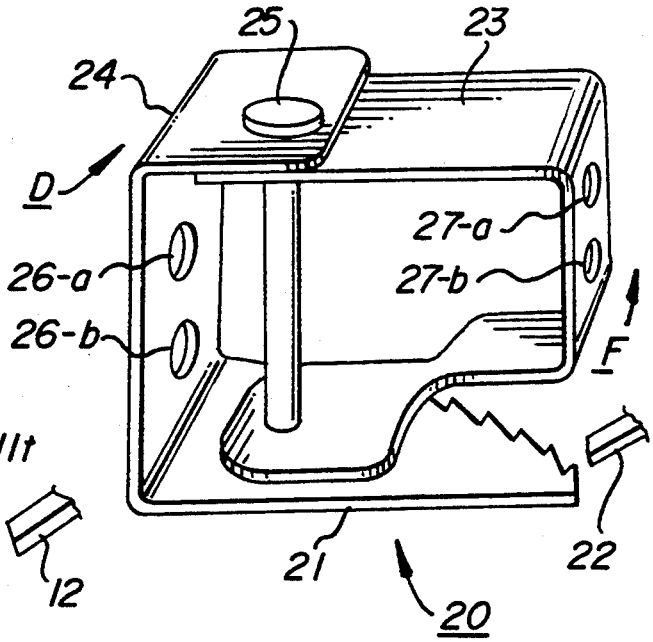
FIG. 2B is a perspective view of a ratchet wheel section affixed to a left-side car door hinge which employes two interleaved U-shaped members.

In an alternative embodiment of FIG. 2B, a left-side car door hinge 20 of interleaved U-shaped members 23 and 24 is shown incorporating the door-holding ratchet 21, which can be similar to the ratchet 11 of FIG. 2A. Again, a pawl tip 22, similar to the tip 11 of FIG. 2A is described in detail below. The ratchet 21 is rigidly affixed to the hinge member 24, which is fastened securely to the door frame D at mounting holes 26-*a* and 26-*b*. Hinge member 23 is securely fastened to the car frame F at mounting holes 27-*a* and 27-*b*. The hinge members 23 and 24 rotate around a hinge bolt 25, so that, when viewed from the top, the ratchet 21 will rotate clockwise as the door is opened and counterclockwise as the door is closed.

When the pawl 22 is engaged with the ratchet 21, clockwise rotation of the ratchet 21 is possible, but counterclockwise rotation is prevented as the last tooth traversed by the pawl locks against the pawl 22. The door is then closed by disengaging the pawl and ratchet. The ratchet and pawl are fabricated from materials that provide substantial strength and resistance to wear.

Figure 3A:
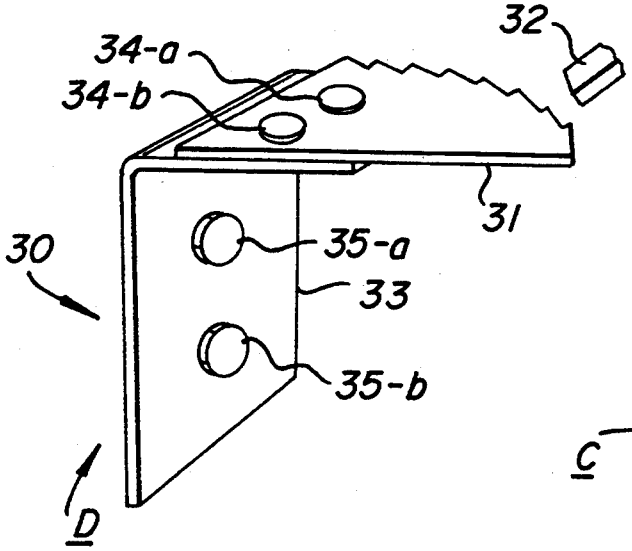
FIG. 3A is a perspective view of a ratchet wheel section on a separate mounting bracket for a left-side car door.

FIG. 3A depicts a ratchet mounting 30 for a left-side car door which is separate from the actual door hinges. Although the mounting places the center of the ratchet wheel 31 in alignment with the hinge axis of the door, considerable freedom is gained with respect to the placement of the ratchet 31 on the door D and the pawl assembly 32 on the car frame. The mounting bracket 33 is fastened to the door frame by bolts 35-*a* and 35-*b*. The ratchet wheel section 31 is fastened to the mounting bracket by bolts 34-*a* and 34-*b*. The pawl 32 and its mounting and control arrangements are described below. Other than the mounting, considerations of operation and fabrication of the ratchet and pawl are the same as for the previously shown arrangements.

Figure 3B:
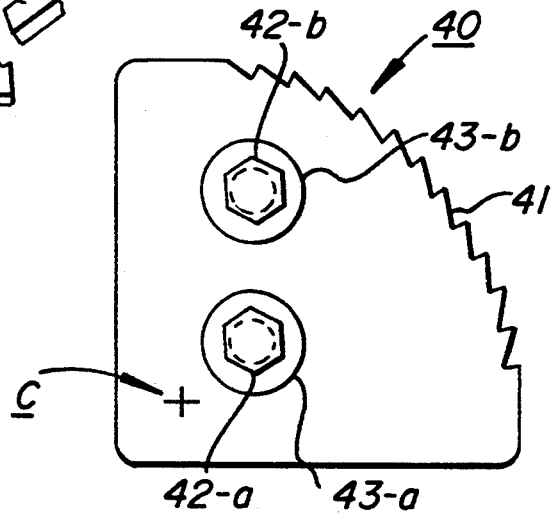
FIG. 3B is a top view of the ratchet wheel section mounted on the bracket shown in FIG. 3A.

FIG. 3B shows a top view 40 of a ratchet wheel section similar to the perspective view in FIG. 3A. Bolts, 42-*a* and 42-*b*, for fastening the ratchet wheel section 41 to the mounting bracket may be threaded into the bracket plate and pass through enlarged holes in the ratchet plate. Flat washers 43-*a* and 43-*b* and lock washers (not shown) will hold the ratchet securely. The enlarged mounting holes in the ratchet plate 41 will allow fine adjustments to be made in the positioning of the ratchet relative to the pawl assembly, which is an advantage over a ratchet which is an integral part of the door hinge. The wheel center C must maintain close alignment with the hinge axis.

Figure 4A:
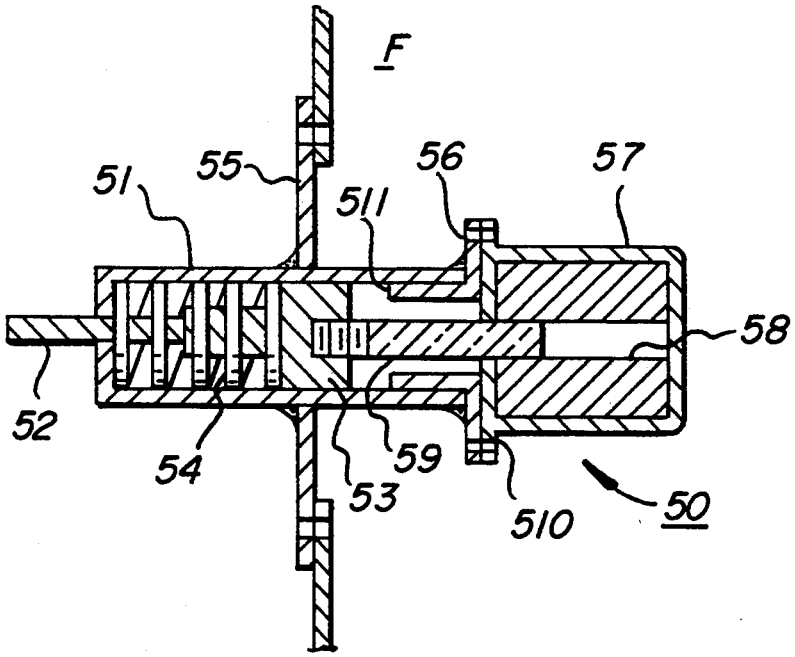
FIG. 4A is a cross-sectional view of a ratchet pawl and activating solenoid assembly for the embodiments of FIGS. 2A through 3B.

FIG. 4A illustrates in cross-section how the pawl 52, representing pawls 12, 22 and 32, can be mounted and controlled. A cylindrical channel 51 is used to guide radially directed movements of the pawl 52, to and from the ratchet wheels 11, 21 and 31. The end portal of the channel 51, through which the pawl 52 protrudes, is rectangular ensuring that once the assembly is properly mounted to the car frame F, the pawl 52 will maintain the desired orientation with respect to the ratchet wheel 11, 21 or 31. The pawl 52 requires a front section of rectangular shape which will slide snugly through the portal of the guide channel 51, and a rear cylindrical piston section 53 which slides snugly within the guide channel 51. The entire assembly 50 is mounted by a flange 55 at a cut-out in the car frame F. This permits a suitable portion of the assembly to extend to the inner side of the car frame. At the inner (remote) end of the guide channel 51, a flange 56 is provided for mounting the solenoid housing 57 by its mounting flange 510 to the guide channel. The circular flange 56 which is welded or otherwise securely fastened to the guide channel contains an inner cylindrical member 511 which fits inside the guide channel. The inner cylinder 511 acts as a reverse motion stop barrier for the pawl piston head 53. A spring 54 (shown uncut) lies between the forward face of the piston head 53 and the front-end face of the channel guide 51. A magnetized rod 59 is threaded into the piston head 53 and extends into the near-side core of the solenoid winding 58.

For operation of the pawl and solenoid assembly 50, current is passed in the proper direction through the solenoid winding 58. This produces a magnetic field of the same polarity at the inner end of the solenoid as the polarity of the magnetic rod 59 in that region. The result is a strong magnetic force propelling the magnetic rod 59, piston 53 and pawl 52 outward compressing the spring 54 and engaging the pawl with the ratchet wheel. When the solenoid is no longer energized, the restoring spring 54 will disengage the pawl from the ratchet wheel. The reverse action by the spring on the piston is constrained by the stop barrier 511 such that the pawl will not drop out of the rectangular portal of the guide channel 51.

Figure 4B:
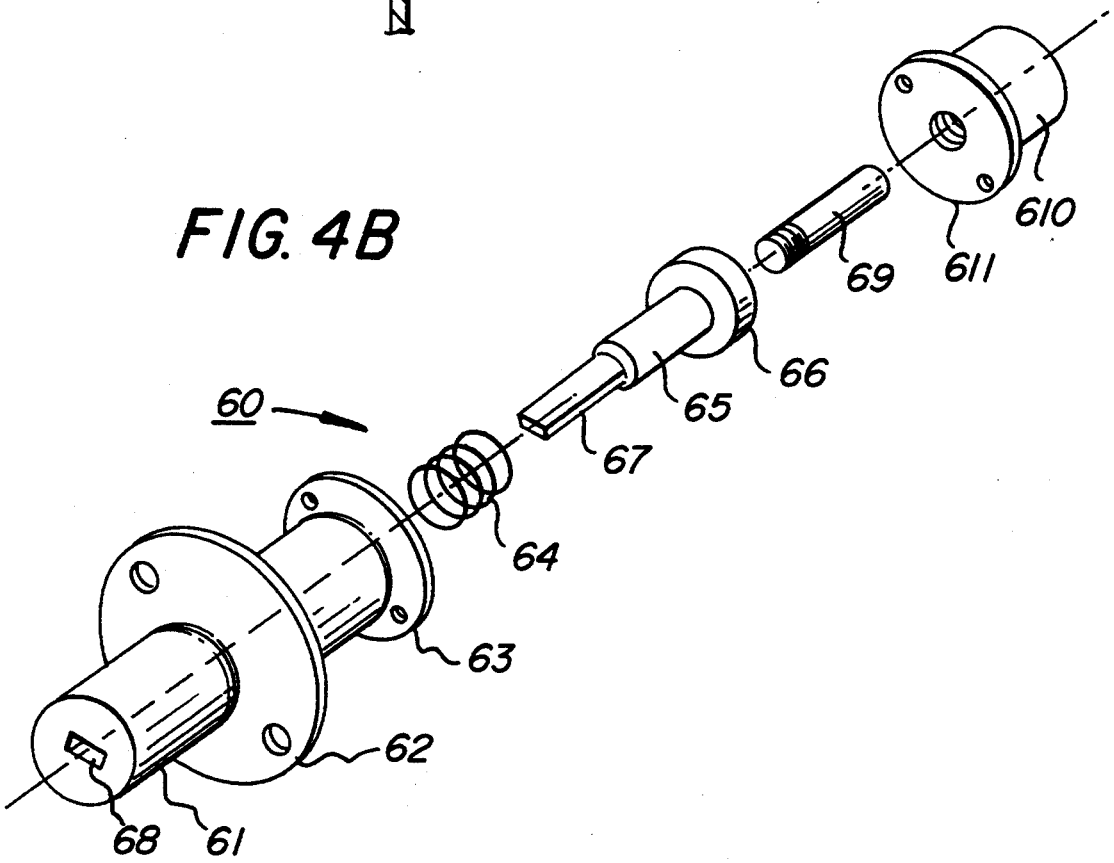
FIG. 4B is an exploded view of the component parts of the pawl and solenoid assembly shown in FIG. 4A.

FIG. 4B provides an exploded view 60 of the component parts of the pawl and solenoid assembly. The guide channel 61 is shown with the rectangular portal 68, the flange 62 for mounting the assembly to the car frame, and the flange 63 for mounting the solenoid housing 610 via its flange 611. The spring 64, pawl 67 and its extension end 65 to the piston head 66, and the magnetized rod 69 must all be assembled and placed into the guide channel 61 before flange 63 with its piston restraining barrier is fastened (welded) to guide channel 61.

Figure 5:
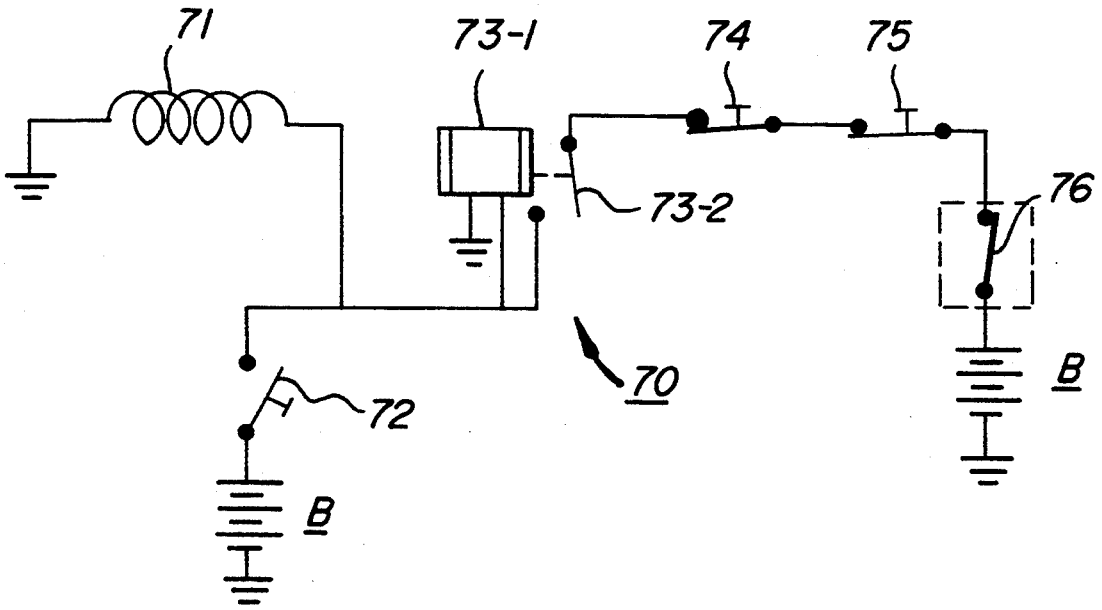
FIG. 5 is a circuit schematic showing the electrical components which permit the user to selectively activate the door holding mechanism, and the components which will release the holding mechanism so that the door may be closed.

FIG. 5 shows an electrical circuit schematic for the electrical components 70 required to selectively activate the door holding mechanism. When the user desires the door to be held during exit from or entry to the car, he/she presses the momentary button switch 72, which connects the car battery B to the pawl solenoid 71 and the coil 73-1 of the non-latching relay. The relay contact 73-2 closes and provides a holding path from the battery B to the relay coil 73-1 and the pawl solenoid 71. These actions occur in a fraction of a second so that the user need only touch and release the spring-restored momentary switch 72 to continuously energize the pawl solenoid. The pawl will remain engaged with the ratchet wheel until the user operates one of the release switches. Switch 74 can be associated with the outside door handle and would be conveniently used to release the door-hold mechanism after exiting from the car by operating the outside door handle. Release switch 75 of the momentary-button type would be conveniently located on the inside door panel or arm-rest and would be operated to release the door-hold mechanism after entering the car, or in any other circumstances where the user uses the door-hold mechanism without leaving the car. Switch 76 is not required for basic operation but is strongly recommended as a safety feature. This switch should be associated with the car ignition switch such that switch 76 is closed when the car ignition is off and open when the car ignition is on. This prevents inadvertently hitting the door hold switch 72 while traveling and leaving the solenoid and relay activated for a long period which could reduce their life, and, of course, would prevent the door being held out if it is accidently opened while the car is moving.

Figure 6:
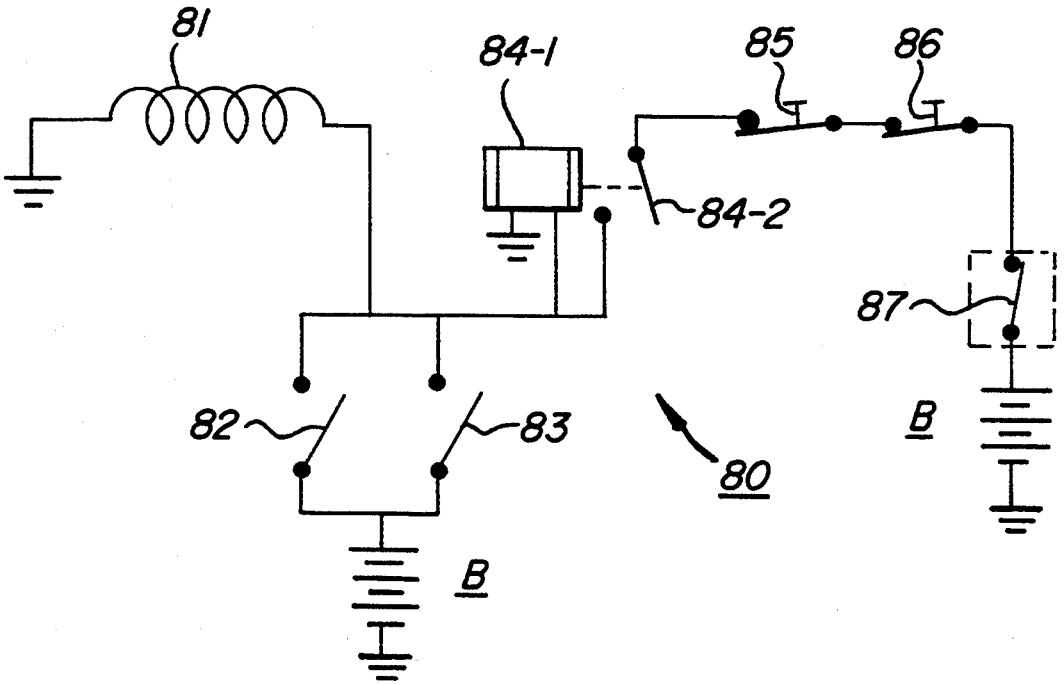
FIG. 6 is a circuit schematic showing the electrical components which will activate the holding mechanism whenever the car door is opened, and the components which will deactivate the holding mechanism so that the car door may be closed.

FIG. 6 is an electrical circuit schematic showing the electrical components 80 employed to activate the door hold mechanism whenever the car door is opened. To prevent this mode of operation from holding the door out if it should be opened while the car is moving, it is even more important that safety switch 87 be incorporated. Switch 87 has the same implementation and operation as switch 76 in FIG. 5. Switch 82 is associated with the inside door handle and switch 83 with the outside door handle such that if either of these handles are operated to open the car door, the associated switch will close connecting the car battery B to the pawl solenoid 81 and the nonlatching holding relay coil 84-1. In a fraction of a second, the relay contact 84-2 closes providing an alternate path for the battery B to send current through the relay coil 84-1 and the solenoid 81. Thus, the door handles may be released as soon as the door is unlatched, and the pawl will remain engaged with the ratchet. Release switch 85 is of the momentary button type and could be conveniently located near the rear upper edge of the door panel so that the hold mechanism can be easily released after exiting from the car without reaching far inside the door. Release switch 86 is of the momentary button type and can be conveniently located on the inside door panel or arm rest for release of the hold mechanism after entering the car, or whenever the door is to be opened and closed while the passenger remains in the car.

Figure 7A:
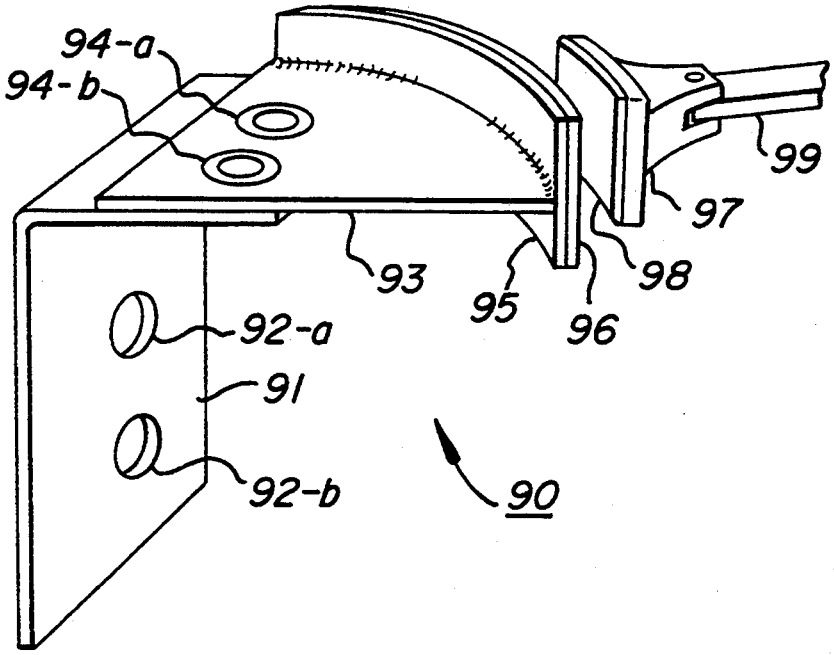
FIG. 7A is a perspective view of a bracket for a left-side car door which is supporting a quarter-circle section of a brake drum. Also shown is the brake shoe with a swivel attachment to the drive rod of an activating solenoid assembly.

FIG. 7A shows for a left-side car door the arrangements 90 for replacing the ratchet and pawl with a section of a brake drum and a brake shoe. A separate mounting bracket 91 is employed (as in FIG. 3A) and is mounted to the door frame via mounting holes **92-*a* and 92-*b* such that the center of the brake drum plate 93 is closely aligned with the door hinge axis. The brake drum plate 93 is mounted to the bracket via bolts and washers at locations 94-*a* and 94-*b*, and again enlarged mounting holes may be used to permit alignment with the brake shoe. The brake shoe 97** employs a swivel coupling to the drive rod from the solenoid assembly mounted on the car frame.

High friction surfaces 96 and 98 are applied to the brake drum 95 and the brake shoe 97 respectively. The brake drum has only rotational movement and the shoe provides radial force from the solenoid action to provide good holding action. Since this application requires only a holding action by the brake in contrast to stopping high-speed rotation, there should be no appreciable wear of the friction surfaces over the life time of use.

Figure 7B:
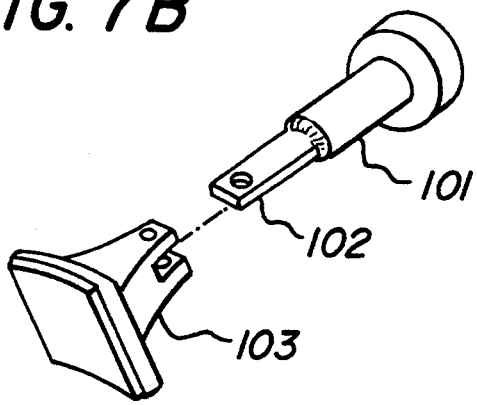
FIG. 7B shows the slight change in the piston and pawl rod of FIGS. 5 and 6 required to accommodate the brake shoe.

FIG. 7B shows how the piston and drive rod of the pawl and solenoid assembly depicted in FIGS. 4A and 4B can be adapted to drive the brake shoe. Only a minor change of the piston and drive rod 101 is required to replace the pawl tooth at the near end with a coupling hole 102 for a hinge-bolt coupling to the swivel mount of the brake shoe 103. All other components depicted in FIGS. 4A and 4B would follow the same design and operational principles.

The electrical components shown in FIG. 5 are appropriate for selectively engaging the brake shoe with the brake drum. However, the method of operation is somewhat different than for the ratchet and pawl. When engaged, the ratchet and pawl permit outward movement of the door but prevent the door from closing from any outward position. Thus, with the ratchet, the user can operate the door-hold switch 72 in FIG. 5 before opening the door and, may frequently choose to do so. With a brake mechanism, the user must open the door first to the desired position and then operate switch 72 in FIG. 5 to hold the door. Consequently, the method of operation implemented for the ratchet and pawl by the circuit schematic of FIG. 6 is not applied to the brake mechanism.

It will be understood that the foregoing detailed description is illustrative only and that other implementations and embodiments of the invention will be apparent to those of ordinary skill in the art, without departing from the scope and claims of the invention.

What is claimed:

1. Apparatus for controlling the positions at which a movable, hinged door can be held securely in relation to a frame, comprising an engageable member mounted on said door; engaging means on said frame for engaging said engageable member at a plurality of different positions of said door relative to said frame to provide a door-hold mechanism;

activating means coupled to said engaging means for activating said engaging means; and a lockout switch associated with said engaging means of said door-hold mechanism so that said door-hold mechanism is not activated when said door is not to be opened.

2. Apparatus as defined in claim 1 wherein said door is attached to the frame of a vehicle and is to be held securely in a prescribed position, said engageable means comprises a ratchet wheel with teeth and said engaging means comprises a pawl and solenoid mounted on the said frame.

3. Apparatus as defined in claim 2 wherein said ratchet wheel has a wheel center and is mounted on said door, which is hinged at an axis with which said wheel center is aligned; thereby to ensure that said ratchet wheel has only rotational movement as the door is opened, and no transverse component of motion, so that said ratchet wheel exerts only tangential force on said pawl, without any radial component of force that would tend to push said pawl back against the action of said solenoid.

4. Apparatus as defined in claim 2 wherein said door has a door plane inclined to the vertical to achieve an inward component of gravitational force on the door, providing for said door to swing closed, even on a level surface, and keep said ratchet and pawl securely engaged.

5. Apparatus as defined in claim 1 wherein said activating means comprises an energizing circuit.

6. Apparatus as defined in claim 5 wherein said energizing circuit comprises means for selectively activating said door-hold mechanism.

7. Apparatus as defined in claim 6 wherein said door has inward and outward positions, including means for detecting a failure of said energizing circuit to cause deactivation and establish normal operation; whereby said apparatus is fail-safe and ensures that said door will not be locked in an outward position in the event of an electrical system failure.

8. Apparatus as defined in claim 7 wherein said energizing circuit includes a solenoid activatable pawl with a pawl restraining spring and said failure causes said pawl restraining spring to deactivate said door-hold mechanism.

9. Apparatus as defined in claim 5 wherein said door has opposite sides and can be opened from either side, and said energizing circuit comprises means for activating said door-hold mechanism regardless of the side from which said door is opened.

10. Apparatus as defined in claim 5 wherein said door has opposite sides and switches for releasing said door-hold mechanism are provided in user convenient positions to provide access on either side of said door.

11. Apparatus as defined in claim 1 wherein said door is on a car having an ignition switch and said lockout switch is associated with said ignition switch so that said door-hold mechanism is not activated if said door is opened while said car is in motion.

12. Apparatus as defined in claim 1 wherein said door is attached to the frame of a vehicle and is to be held fail-safe and securely in a prescribed position, said engageable means comprises a brake drum and said engaging means comprises a brake shoe mounted on said frame.

13. Apparatus as defined in claim 1 wherein said door is attached to the frame of a vehicle and is to be held securely in a prescribed position, said engageable means comprises an electro-mechanical receptor and said engaging means comprises an electro-mechanical contactor mounted on said frame.

14. Movable apparatus for controlling different positions at which a moveable door hinged to a frame can be held securely, comprising engageable means mounted on said door;

engaging means on said frame for engaging said engageable means to hold said door at a prescribed one of a plurality of different positions;

activating means coupled to said engaging means for activating said engaging means and prevention means coupled to said activating means for preventing activation of said engaging means when said door is inadvertently moved from one position to another while said movable apparatus is in motion.

15. Apparatus as defined in claim 14 wherein said door is attached to the frame of a vehicle and is to be held securely in a prescribed position, said engageable means comprises a ratchet wheel with a number of teeth and said engaging means comprises a pawl and solenoid mounted on said frame.

16. Apparatus as defined in claim 15 wherein said door has a number of securely held positions provided by the number of teeth on said ratchet wheel; said door swings from a closed to fully open position through an arc of about 70° and said ratchet wheel is a section confined to one quadrant of a circle, said teeth are in about a 60° to 70° arc of said section of said wheel, with 3 to 4 teeth per inch along said arc.

* * * * *